US010062312B2

(12) United States Patent
Liu et al.

(10) Patent No.: US 10,062,312 B2
(45) Date of Patent: Aug. 28, 2018

(54) METHOD AND APPARATUS FOR DISCRIMINATING LUMINANCE BACKGROUNDS FOR IMAGES, AND A DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Peng Liu, Beijing (CN); Xue Dong, Beijing (CN); Renwei Guo, Beijing (CN); Chungchun Chen, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/122,634

(22) PCT Filed: Sep. 29, 2015

(86) PCT No.: PCT/CN2015/091064

§ 371 (c)(1),
(2) Date: Aug. 30, 2016

(87) PCT Pub. No.: WO2016/179946

PCT Pub. Date: Nov. 17, 2016

(65) Prior Publication Data

US 2017/0154559 A1 Jun. 1, 2017

(30) Foreign Application Priority Data

May 13, 2015 (CN) ..... 2015 1 0241508

(51) Int. Cl.
*G09G 3/20* (2006.01)

(52) U.S. Cl.
CPC ..... *G09G 3/2003* (2013.01); *G09G 3/2074* (2013.01); *G09G 2320/0666* (2013.01)

(58) Field of Classification Search
CPC ..... G09G 3/2003; G09G 3/2074; G09G 2320/0666; G09G 2300/0465;
(Continued)

(56) References Cited

U.S. PATENT DOCUMENTS 6,941,013 B1 9/2005 Drayer
8,560,972 B2 10/2013 Wilson
(Continued)

FOREIGN PATENT DOCUMENTS

CN 1479513 A 3/2004
CN 1564187 A * 1/2005 ..... G01S 7/499
(Continued)

OTHER PUBLICATIONS

Natural Number, Various, 2009, ISO 80000-2, Wikipedia.org.*
(Continued)

*Primary Examiner* — Vinh T Lam
(74) *Attorney, Agent, or Firm* — Womble Bond Dickinson (US) LLP

(57) ABSTRACT

The present disclosure relates to a method and an apparatus for discriminating luminance backgrounds for images and a display apparatus thereof. The method comprises the steps of: receiving image information that is to be discriminated, the image information comprising gray scale values for respective sub-pixels in each pixel; forming the gray scale values for specific sub-pixels of pixels within the s±mth row and the t±nth column in the image information, having a pixel of the sth row, tth column as the center, into a digit group, and arranging the digit group in order, wherein s, m, t and n are natural numbers; if the gray scale values for N greater specific sub-pixels in the digit group are all greater
(Continued)

A

B than a given gray scale value, and a variance is less than or equal to a specified threshold, it is determined that the specific sub-pixels within the s±mth row and the t±nth column are a high-luminance background region; otherwise, it is determined that the specific sub-pixels within the s±mth row and the t±nth column are a non-high-luminance background region. By means of the method of the present disclosure, an image region can be discriminated as a high-luminance region or a non-high-luminance region.

12 Claims, 5 Drawing Sheets

(58) Field of Classification Search
CPC ... G09G 2320/0233; G09G 2320/0626; G09G 2320/0633; G09G 2320/064; G09G 2320/0646; G09G 2320/0653; G09G 2320/0686; H04N 1/40087; H04N 5/235; H04N 5/2351; H04N 5/2353; H04N 5/351; H04N 5/353; H04N 2005/44517; H04N 5/57; H04N 9/77; H04N 9/78; H04N 13/0025; H04N 21/4854; G02F 1/133611
USPC ..... 345/690, 77, 589, 12, 20, 63
See application file for complete search history.

(56) References Cited

U.S. PATENT DOCUMENTS 8,872,743 B2 * 10/2014 Ueno ..... G09G 3/3413 345/102
8,907,973 B2 * 12/2014 Manchi ..... G06T 3/4007 345/426
2007/0086767 A1 4/2007 Nakai
2007/0279494 A1 * 12/2007 Aman ..... G01S 3/7864 348/169
2008/0088649 A1 * 4/2008 Ikeno ..... G09G 3/3611 345/690
2008/0102868 A1 5/2008 Nagamoto et al.
2010/0302449 A1 * 12/2010 Chen ..... H04N 5/20 348/687
2012/0176547 A1 * 7/2012 Guermoud ..... G09G 5/02 348/687
2013/0050235 A1 * 2/2013 Yang ..... G06T 3/4015 345/589
2013/0182002 A1 * 7/2013 Macciola ..... H04N 1/387 345/589
2013/0321679 A1 * 12/2013 Lim ..... H04N 5/23229 348/256
2013/0322746 A1 * 12/2013 Cote ..... G06T 1/20 382/163
2014/0049571 A1 * 2/2014 Erinjippurath .... G02F 1/133606 345/690
2014/0292830 A1 * 10/2014 Harrington ..... G09G 3/344 345/690
2015/0302789 A1 * 10/2015 Furihata ..... G09G 3/2007 345/694

FOREIGN PATENT DOCUMENTS

CN 1581231 A 2/2005
CN 101094306 A 12/2007
CN 101621615 A 1/2010
CN 102376082 A 3/2012
CN 103200361 A 7/2013
EP 1079239 A1 * 2/2001 ..... G01S 7/499

OTHER PUBLICATIONS

Variance, Zhang, Jun. 2012, ICMIC2012, Wikipedia.org.*
Sequence, Gaughan, 2009, ISBN 0-8218-4787-2, Wikipedia.org.*
International Search Report and Written Opinion in PCT/CN2015/091064 dated Feb. 2, 2016, with English translation. 15 pages.
Office Action in Chinese Application No. 201510241508.5 dated Jul. 27, 2017, with English translation.

* cited by examiner

A

B

A

B

A

B

METHOD AND APPARATUS FOR DISCRIMINATING LUMINANCE BACKGROUNDS FOR IMAGES, AND A DISPLAY APPARATUS

The present application is the U.S. national phase entry of PCT/CN2015/091064, with an international filling date of Sep. 29, 2015, which claims the benefit to Chinese Patent Application No. 201510241508.5, filed on May 13, 2015, the entire disclosures of which are incorporated herein by reference.

FIELD

The present disclosure relates to the field of image display and in particular to a method and an apparatus for discriminating luminance backgrounds for images, as well as a display apparatus thereof.

BACKGROUND ART

In the field of display, e.g. in the field of mobile display, a high-luminance background (e.g., white background for a text page) and a low-luminance background (e.g., night mode for a text page) are two very common application scenarios, and the processing ways for these two categories of images are different. However, in the prior art, different luminance backgrounds are merely represented physically by different gray scale values, which lacks the recognition that there is still room for improving the luminance backgrounds for images, so as to better display and process the images.

There is an urgent need in the prior art for a technology to improve the luminance backgrounds for images, so as to display and process the images better.

SUMMARY

In view of above, the present disclosure provides a method and an apparatus for discriminating luminance backgrounds for images, as well as a display apparatus thereof, which can solve or at least alleviate at least a part of the drawbacks existing in the prior art.

According to a first aspect of the present disclosure, a method for discriminating luminance backgrounds for images is provided. The method comprises the steps of: receiving image information that is to be discriminated, the image information comprising gray scale values for respective sub-pixels in each pixel; forming the gray scale values for specific sub-pixels of pixels within the s±mth row and the t±nth column in the image information, having a pixel of the sth row, tth column as the center, into a digit group, and arranging the digit group in order, wherein s, m, t and n are natural numbers; if the greater gray scale values for N specific sub-pixels in the digit group are all greater than a given gray scale value, and a variance is less than or equal to a specified threshold, it is determined that the specific sub-pixels within the s±mth row and the t±nth column are a high-luminance background region; otherwise, it is determined that the specific sub-pixels within the s±mth row and the t±nth column are a non-high-luminance background region.

By means of the method for discriminating luminance backgrounds for images of the present disclosure, luminance backgrounds can be discriminated to different degrees of strictness using different given gray scale values, the number N of the greater specific sub-pixels that are greater than the given gray scale value, and variances against different specified thresholds. For example, an integral image region is discriminated into a high-luminance region, a low-luminance region, and a transitional region in between the high-luminance region and the low-luminance region, respectively. After discriminating the high-luminance region, the low-luminance region and the transitional region, the regions with different luminance backgrounds are refined correspondingly. In other words, the present disclosure is directed to a design where a high-resolution algorithm is based on the high-luminance background discrimination. The present disclosure discriminates the two common backgrounds (high-luminance background and non-high-luminance background) and distinguishes between the high-luminance background and the non-high-luminance background. The present disclosure may alter the degree of strictness in discriminating the high-luminance background by adjusting parameters such as the given gray scale value, the setting for the number N of the greater specific sub-pixels that are greater than the given gray scale value, and/or the specified threshold for variance. By altering the degree of strictness, the range of the high-luminance region to be determined may be altered. The present disclosure may also process by different algorithms with respect to different regions.

In one embodiment of the present disclosure, the variance is less than or equal to 50. Alternatively, the variance is less than or equal to 40.

In another embodiment of the present disclosure, the more the number N of the specific sub-pixels greater than the given gray scale value is, the stricter the discrimination condition is. Alternatively, the larger the given gray scale value is, the stricter the discrimination condition is.

Alternatively, the smaller the variance is, the stricter the discrimination condition is.

In a further embodiment of the present disclosure, the given gray scale value is larger than 180. Alternatively, the given gray scale value is larger than 200.

In a still further embodiment of the present disclosure, the digit group formed by the gray scale values for specific sub-pixels of the pixels within the s+mth row and the t±nth column having the pixel of the sth row, tth column as the center represents gray scale values in an odd number of rows and an odd number of columns. Alternatively, the gray scale values in an odd number of rows and an odd number of columns are gray scale values for specific sub-pixels in 3 rows and 5 columns or 5 rows and 7 columns.

In one embodiment of the present disclosure, the digit group is arranged in a descending order. Alternatively, the digit group is arranged in an ascending order.

In another embodiment of the present disclosure, a low-pass filtering is applied to the digit group of the gray scale values for specific sub-pixels determined as the non-high-luminance background region.

In a further embodiment of the present disclosure, the specific sub-pixel is a red sub-pixel, a green sub-pixel or a blue sub-pixel.

According to a second aspect of the present disclosure, an apparatus for discriminating luminance backgrounds for images is provided. The apparatus comprises: a receiving unit for receiving image information that is to be discriminated, the image information comprising gray scale values for respective sub-pixels in each pixel; a storage unit for forming the gray scale values for specific sub-pixels of pixels within the s±mth row and the t±nth column in the image information, having a pixel of the sth row, tth column as the center, into a digit group, and arranging the digit group in order, wherein s, m, t and n are natural numbers; a determination unit for determining, if the gray scale values for the N greater specific sub-pixels in the digit group are all greater than a given gray scale value, and a variance is less than or equal to a specified threshold, that the specific sub-pixels within the s±mth row and the t±nth column are a high-luminance background region; otherwise, the specific sub-pixels within the s±mth row and the t±nth column are a non-high-luminance background region.

By means of the apparatus for discriminating luminance backgrounds for images of the present disclosure, luminance backgrounds can be discriminated to different degrees of strictness using different given gray scale values, the number N of the greater specific sub-pixels that are greater than the given gray scale value, and variances against different specified thresholds. For example, an integral image region is discriminated into a high-luminance region, a low-luminance region, and a transitional region in between the high-luminance region and the low-luminance region, respectively. After discriminating the high-luminance region, the low-luminance region and the transitional region, the regions with different luminance backgrounds are refined correspondingly. In other words, the present disclosure is directed to a design where a high-resolution algorithm is based on the high-luminance background discrimination. The present disclosure discriminates the two common backgrounds (high-luminance background and non-high-luminance background) and distinguishes between the high-luminance background and the non-high-luminance background. The present disclosure may alter the degree of strictness in discriminating the high-luminance background by adjusting parameters such as the given gray scale value, the setting for the number N of the greater specific sub-pixels that are greater than the given gray scale value, and/or the specified threshold for variance. By altering the degree of strictness, the range of the high-luminance region to be determined may be altered. The present disclosure may also process by different algorithms with respect to different regions.

In one embodiment of the present disclosure, the variance is less than or equal to 50. Alternatively, the variance is less than or equal to 40. In another embodiment of the present disclosure, the more the number N of the specific sub-pixels greater than the given gray scale value is, the stricter the discrimination condition is. Alternatively, the larger the given gray scale value is, the stricter the discrimination condition is. Alternatively, the smaller the variance is, the stricter the discrimination condition is.

According to a third aspect of the present disclosure, a display apparatus is provided. The display apparatus includes a apparatus using the above-described method for discriminating luminance backgrounds for images and/or the above-described apparatus for discriminating luminance backgrounds for images.

By means of the display apparatus of the present disclosure, luminance backgrounds can be discriminated to different degrees of strictness using different given gray scale values, the number N of the greater specific sub-pixels that are greater than the given gray scale value, and variances against different specified thresholds. For example, an integral image region is discriminated into a high-luminance region, a low-luminance region, and a transitional region in between the high-luminance region and the low-luminance region, respectively. After discriminating the high-luminance region, the low-luminance region and the transitional region, the regions with different luminance backgrounds are refined correspondingly. In other words, the present disclosure is directed to a design where a high-resolution algorithm is based on the high-luminance background discrimination. The present disclosure discriminates the two common backgrounds (high-luminance background and non-high-luminance background) and distinguishes between the high-luminance background and the non-high-luminance background. The present disclosure may alter the degree of strictness in discriminating the high-luminance background by adjusting parameters such as the given gray scale value, the setting for the number N of the greater specific sub-pixels that are greater than the given gray scale value, and/or the specified threshold for variance. By altering the degree of strictness, the range of the high-luminance region to be determined may be altered. The present disclosure may also process by different algorithms with respect to different regions.

DETAILED DESCRIPTION OF EMBODIMENTS

In the following, the respective embodiments of the present disclosure are to be described in detail with reference to the FIGS. 1-5 of the present disclosure.

Figure 1:
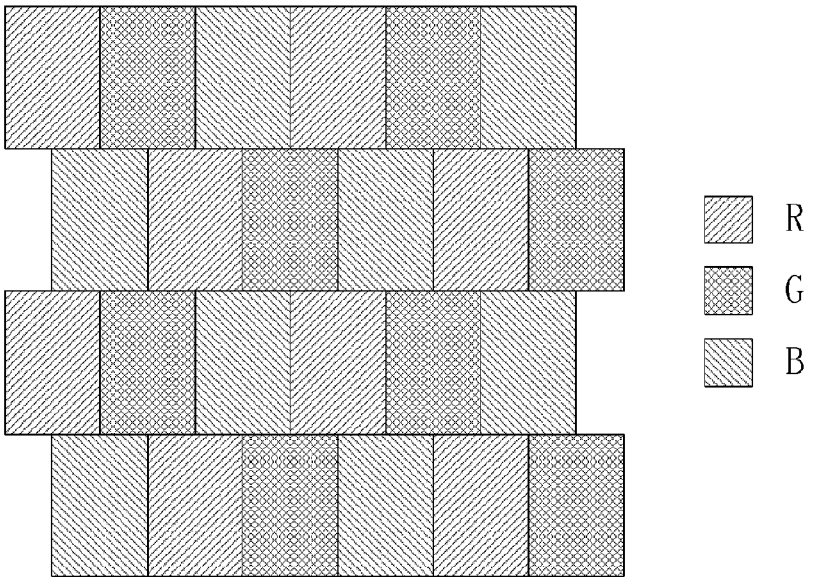
FIGS. 1A and 1B are two arrangement layouts for respective sub-pixels.
Figure 1:
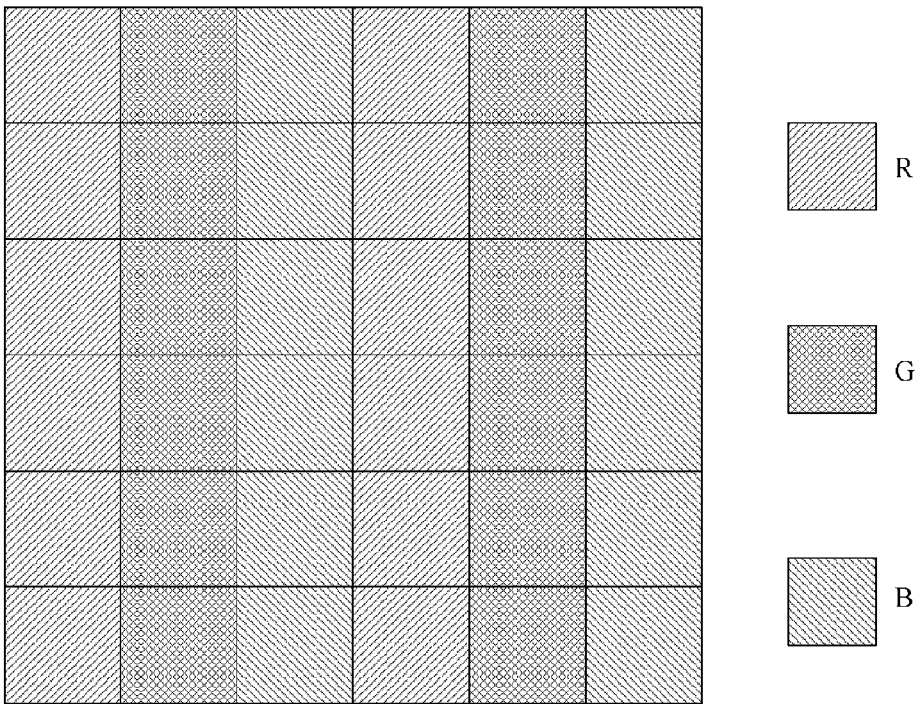
Figure 2:
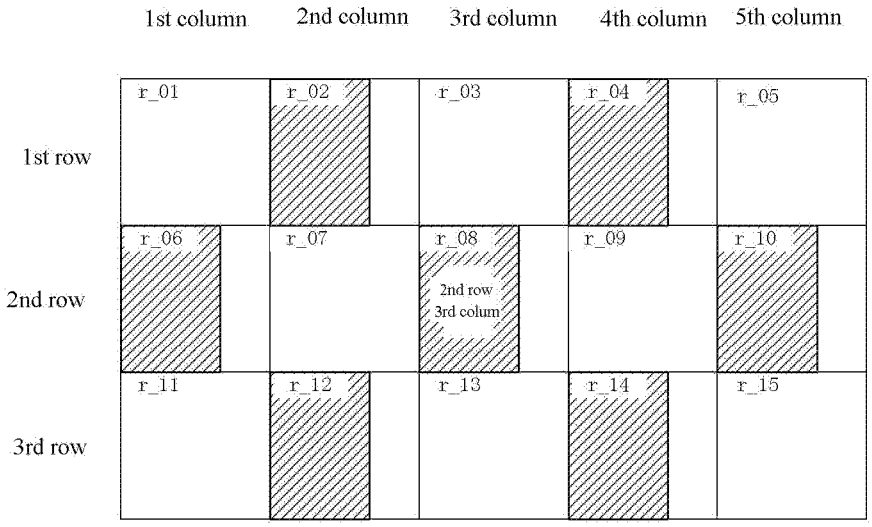
FIG. 2A is an example with red sub-pixels, showing input information for the red sub-pixels in 3 rows and 5 columns having the sth row, tth column as the center in the case of FIG. 1A.
FIG. 2B is an example with red sub-pixels, showing input information for the red sub-pixels in 3 rows and 5 columns having the sth row, tth column as the center in the case of FIG. 1B.
Figure 2:
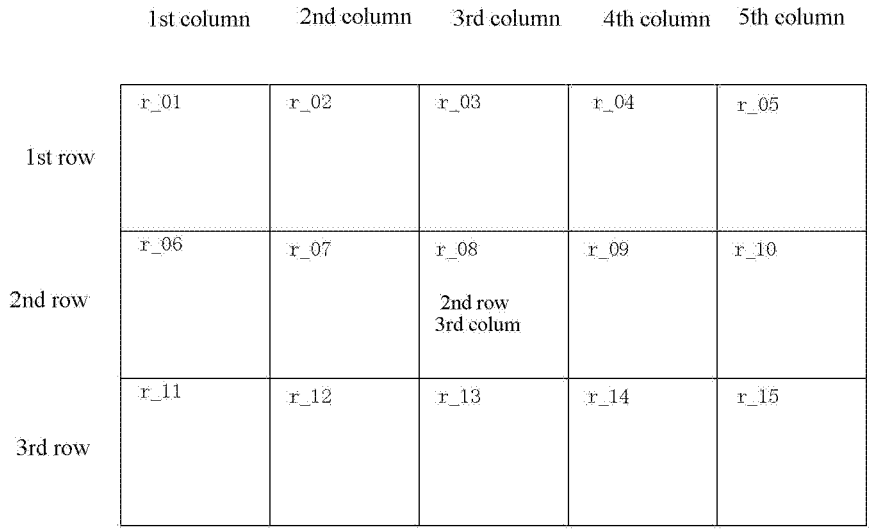
Figure 3:
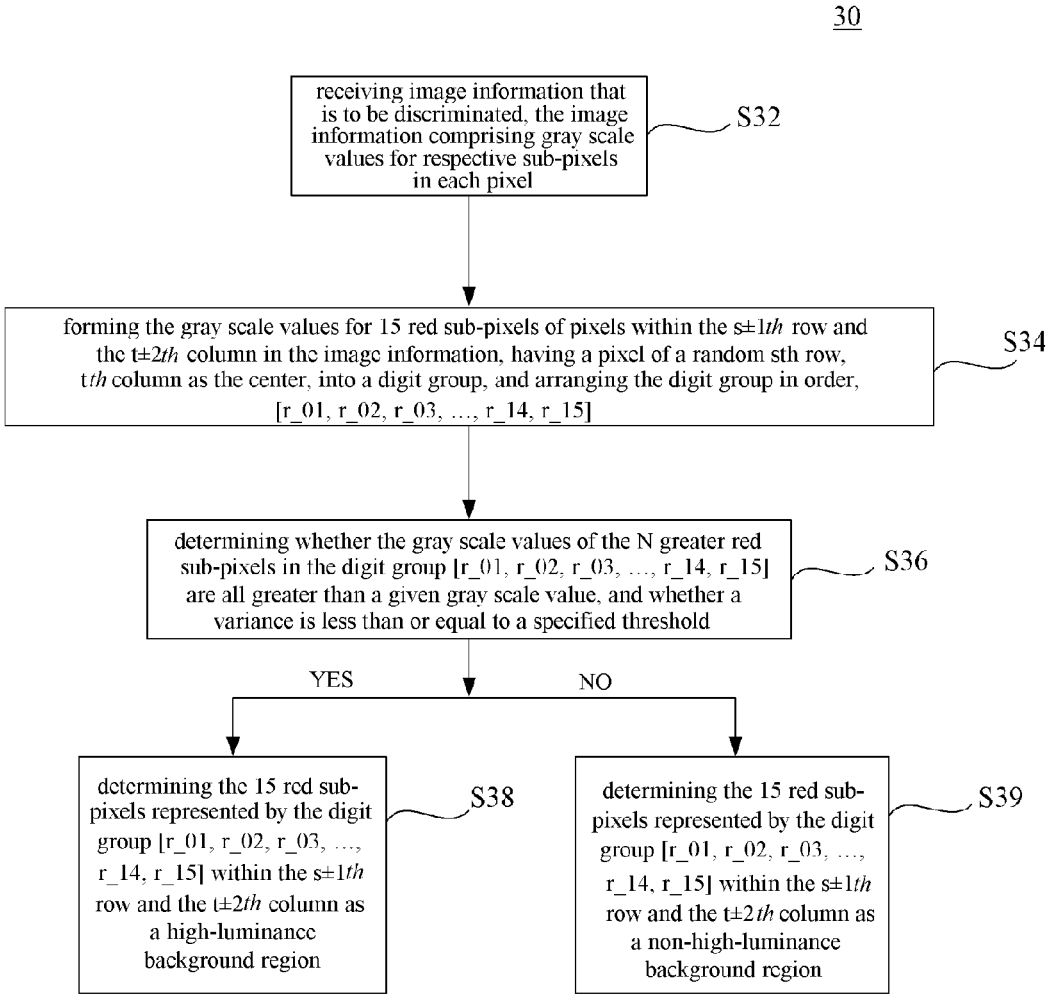
FIG. 3 is a flow chart for a high-luminance background discrimination method according to one embodiment of the present disclosure.

FIG. 3 is a flow chart for a high-luminance background discrimination method according to one embodiment of the present disclosure. The method 30 for discriminating luminance backgrounds for images shown in FIG. 3 may comprise the following steps.

In step S32, image information that is to be discriminated is received, the image information comprising gray scale values for respective sub-pixels in each pixel. For example, the gray scale values may be those for the red sub-pixels in each pixel, represented by a digit group r_01, r_02, r_03, . . . , r_n. Alternatively, the gray scale values may be those for the green sub-pixels in each pixel, represented by a digit group g_01, g_02, g_03, . . . , g_n. Alternatively, the gray scale values may be those for the blue sub-pixels in each pixel, represented by a digit group b_01, b_02, b_03, . . . , b_n. For the convenience of illustration, red sub-pixels are taken as an example for illustration in the following embodiments of the present disclosure. For example, the digit group [r_01, r_02, r_03, . . . , r_14, r_15] is formed by the gray scale values for the red sub-pixels having (s, t) as the center shown in FIGS. 2A and 2B. The situations shown in FIGS. 2A and 2B will be described in detail in the following. It needs to be noted that the red sub-pixels mentioned in the following embodiments are schematic only, while the green sub-pixels, blue sub-pixels or other colored sub-pixels can equally be processed correspondingly. That is, the specific sub-pixels mentioned in the following respective embodiments can be red sub-pixels, green sub-pixels, blue sub-pixels or other colored sub-pixels.

In step S34, the gray scale values for specific sub-pixels (e.g., red sub-pixels) of pixels within the s±mth row and the t±nth column having a pixel of the sth row, tth column as the center in the image information are formed into a digit group, and the digit group is arranged in order, wherein s, m, t and n are natural numbers. In one embodiment of the present disclosure, the sub-pixel arrangement layout shown in FIG. 1 may be adopted. The sub-pixels in this arrangement layout can make full use of a spatial arrangement for the red, green and blue colors, which facilitates the fulfilment of a higher resolution. In this case, the aspect ratio of each sub-pixel, such as a red sub-pixel R, a green sub-pixel G and a blue sub-pixel B, is 2:3. In such an arrangement, three sub-pixels forms two pixels and a repeating group comprises four pixels, i.e., so-called delta pixel arrangement in the art. In the arrangement for red sub-pixels R, green sub-pixels G and blue sub-pixels B shown in FIG. 1A, sub-pixels in the first row are arranged in an order of R, G, B; R, G, B; . . . . Sub-pixels in the second row are arranged in an order of B, R, G; B, R, G; . . . . Besides, the second row is arranged in a staggered displacement of ½ red sub-pixel R with respect to the first row. In other words, the blue sub-pixel B at the beginning of the second row is retracted by the size of half a blue sub-pixel B or half a red sub-pixel R with respect to the red sub-pixel R at the beginning of the first row. The third row repeats the arrangement layout for the first row, and the fourth row repeats the arrangement layout for the second row, and this carries on in order. In this way of arrangement, while the input signal is for s rows and t columns, the display screen made from this arrangement layout may attain the same resolution with only an input for s rows and t/2 columns as with the input for s rows and t columns, thus saving deployment for data lines. Regarding how to attain the same resolution as the s rows and t columns and save deployment for data lines, reference can be made to the other relevant patent application(s) by the applicant for details, which are not the inventive point of the present disclosure and will not be repeated here.

It needs to be noted that FIG. 1A is merely one embodiment of the present disclosure. The arrangement layout for respective sub-pixels in an image in the present disclosure may also adopt the size for a red sub-pixel R, a green sub-pixel G and a blue sub-pixel B in the usual sense, i.e., the aspect ratio is 1:1, e.g., as shown in FIG. 1B, rather than the aspect ratio 2:3 for a red sub-pixel R, a green sub-pixel G and a blue sub-pixel B in FIG. 1A. Likewise, The arrangement layout for respective sub-pixels in an image in the present disclosure may also adopt the arrangement for red sub-pixels R, green sub-pixels G and blue sub-pixels B in the usual sense, as shown in FIG. 1B, rather than the arrangement shown in FIG. 1A in which the second row is staggered from the first row and the fourth row is staggered from the third row. In FIG. 1B, each of the red sub-pixels, the green sub-pixels and the blue sub-pixels are in a respective column, and the red sub-pixel column, the green sub-pixel column and the blue sub-pixel column are arranged alternately in the column direction. With the arrangement layout in FIG. 1B, the technical effect of the present disclosure can equally be achieved.

FIG. 2A is an example with red sub-pixels, showing correspondence between an actual pixel and an input signal for the red sub-pixels in 3 rows and 5 columns (i.e., a 3×5 sub-matrix) having the 2nd row, 3rd column as the center in the case of FIG. 1A. In FIG. 2A, having the 2nd row, 3rd column as the center is only for the convenience of illustration, and has no special meaning. In FIG. 2A, a square region is an input signal, and the corresponding input signals are numbered as r_01, r_02 . . . r_15. A region in slant lines is the position of an actual pixel (position of an output signal), the actual pixels having the 2nd row, 3rd column as the center, and correspondingly, the coordinates for an input signal are the 2nd row, the 5th column. The row number and column number for the corresponding input signal in this region are marked in FIG. 2A. In one embodiment of the present disclosure, gray scale values in an odd number of rows and an odd number of columns represented by a digit group formed by the gray scale values for specific sub-pixels of pixels within 3×5 sub-matrix having a pixel of the 2nd row, 3rd column as the center, may be used. The gray scale values in an odd number of rows and an odd number of columns may be the gray scale values for specific sub-pixels in 3 rows and 5 columns or 5 rows and 7 columns. In the situation shown in FIG. 2A, the gray scale values for red sub-pixels in 3 rows and 5 columns are taken as an example for illustration, i.e., a digit group [r_01, r_02, r_03, . . . , r_14, r_15] is formed by the gray scale values having (s, t) as the center. In this case, the digit group [r_01, r_02, r_03, . . . , r_14, r_15] is a digit group containing the gray scale values for 15 red sub-pixels of the pixels within the 3×5 sub-matrix shown in FIG. 2A. Alternatively, it may be a digit group [r_01, r_02, r_03, . . . , r_34, r_35] formed by the gray scale values for red sub-pixels in 5 rows and 7 columns. In the case of 5 rows and 7 columns (i.e., a 5×7 sub-matrix), the digit group formed by the gray scales values for red sub-pixels is a digit group formed containing the gray scale values for the red sub-pixels of the pixels within the 5×7 sub-matrix, where m is 2 and n is 3. Though not shown in the drawings of the description, a digit group formed by the gray scale values for red sub-pixels in 5 rows and 7 columns is not difficult for a person skilled in the art to understand.

FIG. 2B is an example with red sub-pixels, showing input information for the red sub-pixels in 3 rows and 5 columns (i.e., a 3×5 sub-matrix) having the 2nd row, 3rd column as the center in the case of FIG. 1B. In FIG. 2B, having the 2nd row, 3rd column as the center is only for the convenience of illustration, and has no special meaning. A square region is an input signal, and the corresponding input signals are numbered as r_01, r_02 . . . r_15. In one embodiment of the present disclosure, gray scale values in an odd number of rows and an odd number of columns represented by a digit group formed by the gray scale values for specific sub-pixels of pixels within the 3×5 sub-matrix having a pixel of the 2nd row, 3rd column as the center, may be used. The gray scale values in an odd number of rows and odd number of columns may be the gray scale values for specific sub-pixels in 3 rows and 5 columns or 5 rows and 7 columns. In the situation shown in FIG. 2B, the gray scale values for red sub-pixels in 3 rows and 5 columns are taken as an example for illustration, i.e., a digit group [r_01, r_02, r_03, . . . , r_14, r_15] is formed by the gray scale values having (s, t) as the center. In this case, the digit group [r_01, r_02, r_03, . . . , r_14, r_15] is a digit group containing the gray scale values for 15 red sub-pixels of the pixels within the 3×5 sub-matrix shown in FIG. 2B. Alternatively, it may be a digit group [r_01, r_02, r_03, . . . , r_34, r_35] formed by the gray scale values for red sub-pixels in 5 rows and 7 columns. In the case of 5 rows and 7 columns (i.e., a 5×7 sub-matrix), the digit group formed by the gray scales values for red sub-pixels is a digit group formed by the gray scale values for the red sub-pixels of the pixels within the 5×7 sub-matrix, where m is 2 and n is 3. Though not shown in the drawings of the description, a digit group formed by the gray scale values for red sub-pixels in 5 rows and 7 columns is not difficult for a person skilled in the art to understand.

As mentioned above, a digit group [r_01, r_02, r_03, . . . , r_14, r_15] formed by the gray scale values having the random (s, t) as the center shown in FIG. 2A or FIG. 2B is arranged in order. If the digit group is arranged in a descending order, descreasing sequentially as [r_01, r_02, r_03, . . . , r_14, r_15]. Alternatively, the digit group may also be arranged in an acending order.

In step S36, if the gray scale values for the N greater specific sub-pixels in the digit group are all greater than a given gray scale value, and a variance is less than or equal to a specified threshold, it is determined, in step S38, that the specific sub-pixels within the s±mth row and the t±nth column are a high-luminance background region; otherwise, it is determined, in step S39, that the specific sub-pixels within the s±mth row and the t±nth column are a non-high-luminance background region. For example, for the N greater red sub-pixels in the digit group [r_01, r_02, r_03, . . . , r_14, r_15], the number N may be selected differently according to whether the luminance background discrimination is strict or lenient. It needs to be noted that the more the number N of the specific sub-pixels greater than the given gray scale value is, the stricter the discrimination condition is. For example, under the condition of greater gray scale values than a given gray scale value and a variance less than or equal to a specified threshold, the number N of the specific sub-pixels greater than the given gray scale value is selected to be 7. This means, if seven or more than seven red sub-pixels have their gray levels greater than the given gray scale value, and the variance is less than or equal to a specified threshold, it is determined that the 15 red sub-pixels represented by the gray scale values having the random (s, t) as the center are all of a high-luminance background region. On the contrary, if less than seven (not including seven) red sub-pixels have their gray levels greater than the given gray scale value, and the variance is less than or equal to a specified threshold, it is determined that the 15 red sub-pixels represented by the gray scale values having the random (s, t) as the center are all of a non-high-luminance background region. Similarly, under the condition of greater gray scale values than a given gray scale value and a variance less than or equal to a specified threshold, the number N of the specific sub-pixels greater than the given gray scale value is selected to be 5. This means, if five or more than five red sub-pixels have their gray levels greater than the given gray scale value, and the variance is less than or equal to a specified threshold, it is determined that the 15 red sub-pixels represented by the gray scale values having the random (s, t) as the center are all of a high-luminance background region. On the contrary, if less than five (not including five) red sub-pixels have their gray levels greater than the given gray scale value, and the variance is less than or equal to a specified threshold, it is determined that the 15 red sub-pixels represented by the gray scale values having the random (s, t) as the center are all of a non-high-luminance background region. Obviously, the condition is stricter when the number N of the specific sub-pixels greater than the given gray scale value is selected to be 7 than when it is selected to be 5.

For different degrees of strictness, the discrimination results are different. For example, FIG. 5 provides an example for a lenient high-luminance discrimination A and a strict high-luminance discrimination B according to one embodiment of the present disclosure.

Figure 5:
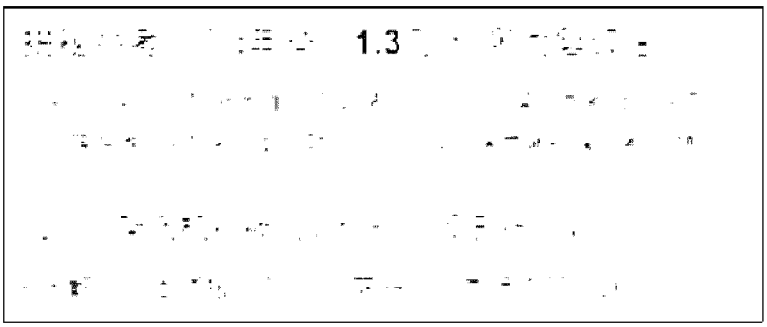
FIG. 5 provides an example for a lenient high-luminance background discrimination and a strict high-luminance background discrimination according to one embodiment of the present disclosure.
Figure 5:
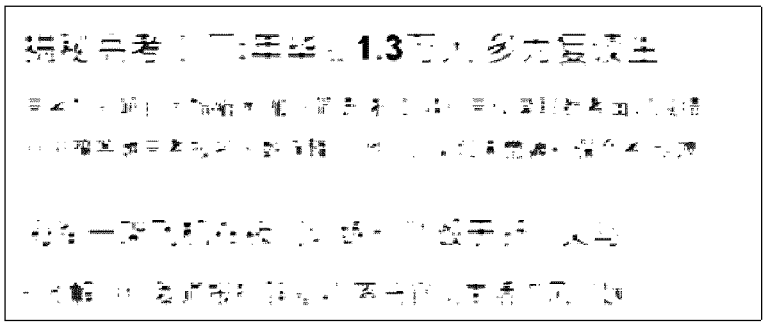

FIG. 5 is the results of display when the content for display on screen is shown against luminance discriminations in different degrees of strictness. When the number N of the specific sub-pixels greater than the given gray scale value is relatively small, as shown by figure A in FIG. 5, the image at many regions around the numeral "1.3" is discriminated as in high luminance, and is displayed in white, whereas the other regions are displayed in black. In other words, under such a luminance background discrimination, more regions are discriminated as high-luminance regions and fewer regions are discriminated as non-high-luminance regions. A result of the image display is that the image has more white portions and fewer black portions. A luminance discrimination like this can be called a "lenient high-luminance discrimination". Alternatively, another type of discrimination in a higher degree of strictness is carried out with the same image displayed on the screen. That is, when the number N of the specific sub-pixels greater than the given gray scale value is relatively large, as shown by figure B in FIG. 5, the image at many regions around the numeral "1.3" is discriminated as in non-high luminance, and is displayed in black, whereas the other regions are displayed in white. In other words, under such a luminance background discrimination, more regions are discriminated as non-high-luminance regions and fewer regions are discriminated as high-luminance regions. A result of the image display is that the image has more black portions and fewer white portions. A luminance discrimination like this can be called a "strict high-luminance discrimination". Other factors to affect the degree of strictness will also be described in detail in the following.

Figure 4:
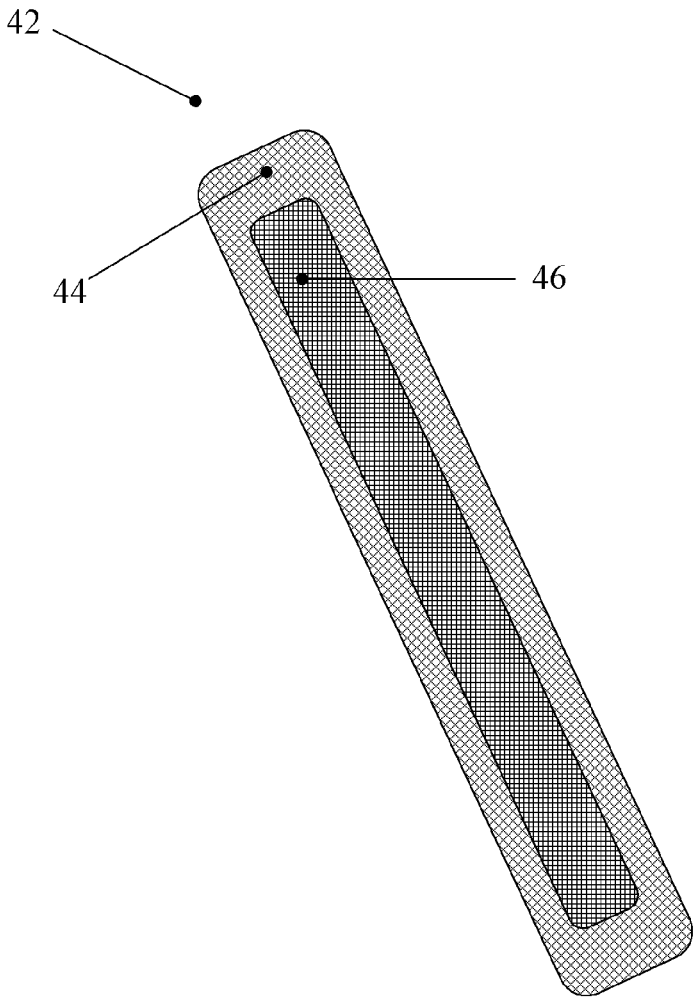
FIG. 4 is a discrimination result for the high-luminance background discrimination according to one embodiment of the present disclosure.

In another embodiment of the present disclosure, the image at the discriminated non-high-luminance background regions may be further processed. For example, a low-pass filtering is applied to the digit group of the gray scale values for specific sub-pixels discriminated as a non-high-luminance background region. Specifically, for the same image, a result of subtracting the image obtained with a strict condition for luminance background discrimination from the image obtained with a lenient condition for luminance background discrimination is called a transitional region. Then, a low-pass filtering is applied to this transitional region. In other words, the non-high-luminance background region actually include the transitional region and the genuine low-luminance background region. It is for the subsequent application of a low-pass filtering to the transitional region that the transitional region is distinguished from the non-high-luminance background region, whereby the color burrs shown at the edges of the image, such as a character, can be improved. It needs to be noted here that it is not necessary to apply the low-pass filtering to the transitional region. In some cases, e.g., in a case where the color burrs shown at the edges of the image, such as a character, are not very serious, the step of the low-pass filtering to the transitional region can be omitted. FIG. 4 is a discrimination result for a high-luminance background discrimination according to one embodiment of the present disclosure. FIG. 4 shows that an image is discriminated into three parts: high-luminance background region 42, low-luminance background region 46 and transitional region 44. For the high-luminance background region 42, a corresponding high-luminance algorithm may be performed subsequently.

For the low-luminance background region 46, a corresponding low-luminance algorithm may be performed subsequently. For the transitional region 44, a low-pass filtering may be performed subsequently. Regarding how to carry out the corresponding high-luminance algorithm, low-luminance algorithm and low-pass filtering algorithm, a person skilled in the art can make reference to the other relevant patent application(s) by the applicant for details, which are not the inventive point of the present disclosure and will not be repeated here.

It is known to a person skilled in the art that a variance is the mean for a sum of the squares of differences between each data and the mean thereof, and a variance is to measure the degree of deviation between a random variable and its mathematical expectation (i.e., the mean value). In each embodiment of the present disclosure, a variance of the digit group [r_01, r_02, r_03, . . . , r_14, r_15] is less than or equal to 50. Preferably, a variance of the digit group [r_01, r_02, r_03, . . . , r_14, r_15] is less than or equal to 40.

In each embodiment of the present disclosure, the input image information includes the gray scale values for respective sub-pixels in each pixel. The gray scale values for the respective sub-pixels are in the range of 0-256 in an usual sense, wherein the given gray scale value may be larger than 180. Preferably, the given gray scale value is larger than 200.

It needs to be noted that as mentioned above, a difference in the number N of the greater specific sub-pixels that are greater than the given gray scale value affects the degree of strictness for the luminance background discrimination. For example, in the digit group [r_01, r_02, r_03, . . . , r_14, r_15] formed by the gray scale values for 15 red sub-pixels, when the given gray scale value is selected to be 180, if the number of the greater specific sub-pixels in the digit group that are greater than the given gray scale value 180 is set to be 7, and if in fact there are 8 greater red sub-pixels each having a gray scale value above the given gray scale value 180, and the variance is less than or equal to a specified threshold, it is then determined that the red sub-pixels within the s±1th row and the t±2th column are a high-luminance background region; if in fact there are 6 greater red sub-pixels each having a gray scale value above the given gray scale value 180, and the variance is less than or equal to a specified threshold, it is still determined that the red sub-pixels within the s±1th row and the t±2th column are a non-high-luminance background region. When the given gray scale value is selected to be 200, if the number of the greater specific sub-pixels in the digit group that are greater than the gray scale value 200 is still set to be 7, and if in fact there are 8 greater red sub-pixels each having a gray scale value above the given gray scale value 200, and the variance is less than or equal to a specified threshold, it is then determined that the red sub-pixels within the s±1th row and the t±2th column are a high-luminance background region; if in fact there are 6 greater red sub-pixels each having a gray scale value above the given gray scale value 200, and the variance is less than or equal to a specified threshold, it is still determined that the red sub-pixels within the s±1th row and the t±2th column are a non-high-luminance background region. Obviously, the greater the given gray scale value is set to be, the stricter the luminance background discrimination is. It thus can be seen that the setting for the given gray scale value has an impact on the degree of strictness for the luminance background discrimination.

In addition, it further needs to be noted that there may be also different settings, as required, to the specified threshold for the variance. For example, in the digit group [r_01, r_02, r_03, . . . , r_14, r_15] formed by the gray scale values for 15 red sub-pixels, when the given gray scale value is set to be 180, in the case that the number N of the greater red sub-pixels that are greater than the given gray scale value 180 is set to be 7, while in fact there are 8 in the digit group [r_01, r_02, r_03, . . . , r_14, r_15] having a gray scale value above 180, the variance of the 8 gray scale values is 40. If the specified threshold for the variance is set to be 45, since the variance 40 of the 8 gray scale values is less than the set variance threshold 45, it is determined that the region of the 15 red sub-pixels represented by the digit group [r_01, r_02, r_03, . . . , r_14, r_15] is a high-luminance background region. If the specified threshold for the variance is set to be 39, since the variance 40 of the 8 gray scale values is larger than the set variance threshold 39, it is determined that the region of the 15 red sub-pixels represented by the digit group [r_01, r_02, r_03, . . . , r_14, r_15] are a non-high-luminance background region, although the other two conditions have been met, i.e., there are 8 (more than 7 as the set number for the greater N red sub-pixels) in the digit group [r_01, r_02, r_03, . . . , r_14, r_15] above the given gray scale value 180. It thus can be seen that the setting for the specified threshold for the variance has an impact on the degree of strictness for the luminance background discrimination.

It can be seen based on the above analysis that each of the different given gray scale values, the number N of the greater specific sub-pixels that are greater than the given gray scale value, and the variance against different specified thresholds can generate an impact on the degree of strictness for the luminance background discrimination. These three are all parameters to affect the degree of strictness for the luminance background discrimination and are independent from each other.

In one embodiment of the present disclosure, the given gray scale value may be selected to be 200, the specified threshold for the variance is 50, and the number N of the greater red sub-pixels that are greater than the given gray scale value is set to be 5. If in fact there are more than 5 greater red sub-pixels each having a gray scale value above the given gray scale value 200 and the variance is less than or equal to the specified threshold 50, it is determined that the 15 red sub-pixels within the s±1th row and the t±2th column are a high-luminance background region. Otherwise, it is determined that the 15 red sub-pixels within the s±1th row and the t±2th column are a non-high-luminance background region.

By means of the method for discriminating luminance backgrounds for images of the present disclosure, luminance backgrounds can be discriminated to different degrees of strictness using different given gray scale values, the number N of the greater specific sub-pixels that are greater than the given gray scale value, and variances against different specified thresholds. For example, an integral image region is discriminated into a high-luminance region, a low-luminance region, and a transitional region in between the high-luminance region and the low-luminance region, respectively. After discriminating the high-luminance region, the low-luminance region and the transitional region, the regions with different luminance backgrounds are refined correspondingly. In other words, the present disclosure is directed to a design where a high-resolution algorithm is based on the high-luminance background discrimination. The present disclosure discriminates the two common backgrounds (high-luminance background and non-high-luminance background) and distinguishes between the high-luminance background and the non-high-luminance background. The present disclosure may alter the degree of strictness in discriminating the high-luminance background by adjusting parameters such as the given gray scale value, the setting for the number N of the greater specific sub-pixels that are greater than the given gray scale value, and/or the specified threshold for variance. By altering the degree of strictness, the range of the high-luminance region to be determined may be altered. The present disclosure may also process by different algorithms with respect to different regions.

As mentioned above, the range of the high-luminance region as determined may be different when discrimination algorithms to different degrees of strictness are used. As shown in FIG. 5A, a lenient luminance background discrimination results in more white background and less black background. As shown in FIG. 5B, a strict luminance background discrimination results in less white background and more black background.

The luminance background discrimination method of the present disclosure needs to refer to the luminance data in one region, and determines the luminance background according to a range of these data. As mentioned above, the range of these data may be adjusted by using different given gray scale values, the number N of the greater specific sub-pixels that are greater than the given gray scale value, and variances against different specified thresholds, so as to alter the degree of strictness for the discrimination algorithms.

According to a second aspect of the present disclosure, an apparatus for discriminating luminance backgrounds for images is provided. The apparatus may comprise: a receiving unit for receiving image information that is to be discriminated, the image information comprising gray scale values for respective sub-pixels in each pixel; a storage unit for forming the gray scale values for specific sub-pixels of pixels within the s±mth row and the t±nth column in the image information, having a pixel of the sth row, tth column as the center, into a digit group, and arranging the digit group in order, wherein s, m, t and n are natural numbers; a determination unit for determining, if the gray scale values for the N greater specific sub-pixels in the digit group are all greater than a given gray scale value, and a variance is less than or equal to a specified threshold, that the specific sub-pixels within the s±mth row and the t±nth column are a high-luminance background region; otherwise, the specific sub-pixels within the s±mth row and the t±nth column are a non-high-luminance background region.

In the apparatus for discriminating luminance backgrounds for images of the present disclosure, luminance backgrounds can be discriminated to different degrees of strictness using different given gray scale values, the number N of the greater specific sub-pixels that are greater than the given gray scale value, and variances against different specified thresholds. For example, an integral image region is discriminated into a high-luminance region, a low-luminance region, and a transitional region in between the high-luminance region and the low-luminance region, respectively. After discriminating the high-luminance region, the low-luminance region and the transitional region, the regions with different luminance backgrounds are refined correspondingly. In other words, the present disclosure is directed to a design where a high-resolution algorithm is based on the high-luminance background discrimination. The present disclosure discriminates the two common backgrounds (high-luminance background and non-high-luminance background) and distinguishes between the high-luminance background and the non-high-luminance background. The present disclosure may alter the degree of strictness in discriminating the high-luminance background by adjusting parameters such as the given gray scale value, the setting for the number N of the greater specific sub-pixels that are greater than the given gray scale value, and/or the specified threshold for variance. By altering the degree of strictness, the range of the high-luminance region to be determined. The present disclosure may also process by different algorithms with respect to different regions.

Alternatively, the variance is less than or equal to 50. Alternatively, the variance is less than or equal to 40.

Alternatively, the more the number N of the specific sub-pixels greater than the given gray scale value is, the stricter the discrimination condition is. Alternatively, the larger the given gray scale value is, the stricter the discrimination condition is. Alternatively, the smaller the variance is, the stricter the discrimination condition is.

According to a third aspect of the present disclosure, a display apparatus is provided. The display apparatus may include a apparatus using the above-described method for discriminating luminance backgrounds for images and/or the above-described apparatus for discriminating luminance backgrounds for images.

Although the present disclosure has been described with reference to the embodiments within current consideration, it should be understood that the present disclosure is not limited to the disclosed embodiments. On the contrary, the present disclosure is intended to contain various modifications and equivalent arrangements that are included in the scope of the appended claims. The scope of the following claims conforms to explanations in a broadest sense, so as to include every one of such modifications and equivalent structures and functions.

The invention claimed is:

1. A method for classifying background regions of an image, comprising a plurality of steps:

receiving an image, wherein the image comprises a plurality of pixels in a matrix, each pixel comprising one or more sub-pixels;

analyzing the received image to obtain gray scale values for sub-pixels of pixels in a $(2m+1)\times(2n+1)$ sub-matrix, wherein a pixel in a sth row, tth column is chosen as a center of the $(2m+1)\times(2n+1)$ sub-matrix, and wherein s, m, t and n are positive integers;

selecting, from the $(2m+1)\times(2n+1)$ sub-matrix, N sub-pixels all having greater gray scale values than any of the rest of the sub-pixels in the $(2m+1)\times(2n+1)$ sub-matrix;

making comparisons between the gray scale values for the N sub-pixels and a given gray scale value as well as between a variance of the gray scale values for the N sub-pixels and a specified threshold; and classifying pixels in the $(2m+1)\times(2n+1)$ sub-matrix into a high-luminance background region, if the gray scale values for the N sub-pixels are all greater than the given gray scale value and the variance of the gray scale values for the N sub-pixels is less than or equal to the specified threshold; and otherwise, classifying pixels in the $(2m+1)\times(2n+1)$ sub-matrix into a non-high-luminance background region.

2. The method for classifying background regions of an image according to claim 1, wherein the variance is less than or equal to 50.

3. The method for classifying background regions of an image according to claim 2, wherein the variance is less than or equal to 40.

4. The method for classifying background regions of an image according to claim 2, wherein a more the number N of the sub-pixels greater than the given gray scale value is, a stricter a classifying condition is.

5. The method for classifying background regions of an image according to claim 2, wherein a larger the given gray scale value is, a stricter a classifying condition is.

6. The method for classifying background regions of an image according to claim 2, wherein a smaller the variance is, a stricter a classifying condition is.

7. The method for classifying background regions of an image according to claim 4, wherein the given gray scale value is larger than 180.

8. The method for classifying background regions of an image according to claim 7, wherein the given gray scale value is larger than 200.

9. The method for classifying background regions of an image according to claim 7, wherein the gray scale values for sub-pixels in the $(2m+1)\times(2n+1)$ sub-matrix are gray scale values for sub-pixels in a $(3\times5)$ or $(5\times7)$ sub-matrix.

10. The method for classifying background regions of an image according to claim 9, wherein a low-pass filtering is applied to the pixels in the $(2m+1)\times(2n+1)$ sub-matrix, if they are classified into the non-high-luminance background region.

11. The method for classifying background regions of an image according to claim 1, wherein the sub-pixels comprise a red sub-pixel, a green sub-pixel or a blue sub-pixel.

12. A display apparatus, which includes an apparatus using the method for classifying background regions of an image according to claim 1.

* * * * *